US006915546B2

(12) United States Patent
Kasai

(10) Patent No.: US 6,915,546 B2
(45) Date of Patent: Jul. 12, 2005

(54) PLASTIC FASTENER WITH SLIDER AND BAG BODY WITH PLASTIC FASTENER

(75) Inventor: Juichi Kasai, Tokyo (JP)

(73) Assignee: Showa Highpolymer Co., Ltd., Tokyo (JP)

( * ) Notice: Subject to any disclaimer, the term of this patent is extended or adjusted under 35 U.S.C. 154(b) by 0 days.

(21) Appl. No.: 10/381,436

(22) PCT Filed: Sep. 4, 2001

(86) PCT No.: PCT/JP01/07648

§ 371 (c)(1),
(2), (4) Date: Mar. 31, 2003

(87) PCT Pub. No.: WO03/022697

PCT Pub. Date: Mar. 20, 2003

(65) Prior Publication Data

US 2004/0010893 A1 Jan. 22, 2004

(51) Int. Cl.[7] ..... A44B 19/16
(52) U.S. Cl. ..... 24/30.5 R; 24/400
(58) Field of Search ..... 24/30.5 R, 399, 24/400, 430, 585.11, 384, 585.12, 387, 388, 435, 436; 383/64, 69, 61.3; 53/133.4, 139.2; 493/213, 215, 927

(56) References Cited

U.S. PATENT DOCUMENTS

| | | | | |
|---|---|---|---|---|
| 2,637,086 A | * | 5/1953 | Philips | 24/382 |
| 5,020,194 A | | 6/1991 | Herrington et al. | |
| 5,689,866 A | | 11/1997 | Kasai et al. | |
| 6,088,887 A | * | 7/2000 | Bois | 24/399 |
| 6,789,947 B1 | | 9/2004 | Kasai | |
| 2004/0025308 A1 | | 2/2004 | Kasai | |
| 2004/0045138 A1 | | 3/2004 | Kasai | |

FOREIGN PATENT DOCUMENTS

| | | |
|---|---|---|
| JP | 5-505325 | 8/1993 |
| JP | 6-77518 | 11/1994 |
| JP | 08-214920 | 8/1996 |
| JP | 10-503672 | 4/1998 |
| JP | 2000-152810 | 6/2000 |
| JP | 2001-130594 | 5/2001 |

* cited by examiner

*Primary Examiner*—James R. Brittain
(74) *Attorney, Agent, or Firm*—Oblon, Spivak, McClelland, Maier & Neustadt, P.C.

(57) ABSTRACT

A plastic zipper equipped with a slider, and a bag body equipped with the plastic zipper, the plastic zipper having a strong opening force despite its miniaturization. The hermetically sealing plastic zipper is equipped with a slider for opening and closing the zipper, and includes a pair of a male hook and a female hook, flanges on opening portion sides for each of the male and female hooks connectable at respective top end portions, and a wedged opening plate pressed into the inside of a closed plastic cylinder constituted of the connectable flange top end portions and extended to the zipper in an engaged state so that the zipper is firstly opened and after the zipper is opened, the top end portions of the flanges in a connected state are disconnected.

9 Claims, 17 Drawing Sheets

PLASTIC FASTENER WITH SLIDER AND BAG BODY WITH PLASTIC FASTENER

TECHNICAL FIELD

The present invention relates to a plastic zipper equipped with a slider. The zipper is employed in packaging materials for foods, pharmaceuticals, electronic part items and the like, and is capable of keeping hermetical sealability even after repeated opening and closing operations, and which enables easy opening and resealing. The present invention also pertains to a bag body equipped with the above-mentioned plastic zipper.

BACKGROUND ART

There are widely employed, as packaging materials for a variety of articles in the fields of foods, pharmaceuticals, electronic part items and the like, bag bodies each equipped on the opening portion with a plastic zipper composed of a pair of male and female hooks on a surface of a plastic film. In particular, there are widely employed plastic zippers each equipped with a slider which is used for opening and closing the zippers because of easiness in opening and closing operations.

This slider is composed of an outside guide and an inside guide. The slider usually employed has a structure that the inside guide is inserted between the male and the female hooks and causes the male/female hooks to disengage, while the outside guide causes the male/female hooks to engage {refer to Japanese Patent Application Laid-Open No. 214920/1996 (Heisei 8)}.

Since in the slider of the conventional structure, the inside guide is inserted between the hooks of a zipper, even if the zipper is completely bound tight, the content in a bag leaks through a gap between the hooks and the inside guide which is inserted between the hooks. Hence, the above-mentioned zipper is unusable for applications requiring hermetical sealing and is for applications not requiring hermetical sealing such as general cargoes.

On the other hand, there is proposed a zipper having such a structure that hermetical sealing can be maintained in a state of a bag being closed with a slider by the use of a specially shaped plastic zipper and a slider adapted thereto (for instance, U.S. Pat. Nos. 5,067,208 and 5,664,299).

In the plastic zippers as disclosed therein, hermetical sealability is maintained by taking advantage of the elasticity of the plastic material which constitutes the zipper for the purpose of facilitating the disengagement even with a weak force, and therefore when the elasticity thereof varies with a variation in temperature or the like, there is caused a fear of incapability of maintaining the hermetical sealability after opening and closing operations, whereby the amount of leakage is increased. Such being the case, the above-proposed zippers are unusable for packaging such content as liquid and the like in which occurrence of leakage is forbidden.

The present inventor previously proposed a hermetically sealable plastic zipper that formed male hooks and female hooks of the zipper on the surface of a plastic, forming a continuous tightening wall parallel to the male hooks on the inside thereof, and further that formed a continuous pressing rib parallel to the female hooks on the inside thereof, so that the zipper is imparted with excellent properties in persistent hermetical-sealability and also impact resistance by the tight contact between the continuous tightening wall and the continuous pressing rib as well as self-tightening effect thereof (Japanese Patent Registration No. 2,938,784). The hermetically sealable plastic zipper is excellent in hermetical sealability and impact resistance and almost free from performance variation due to temperature variation, and accordingly is well suited for packaging liquid and the like.

In addition, the present inventor previously proposed a slider shown in Japanese Patent Application Laid-Open No. 130594/2001 (Heisei 13) which was adapted to the aforesaid hermetically sealable plastic zipper and which does not impair the hermetical sealability thereof, and a plastic zipper equipped with the above-mentioned slider. The constitution thereof is illustrated on FIG. 10, in which protrusions G2-1, G1-2 each serving as a guide for the slider are installed on the opening portion side flange portion (extension portion) of an opening side hook so that the protrusions are parallel to the slider, and also an inside guide S-1 is installed on the plate portion C of the slider S so that the inside guide is positioned between the protrusions and the hooks on the side of the opening portion of the zipper, so as to enable the hermetically sealable plastic zipper to be opened and closed by sliding the slider S as illustrated on FIG. 12 and FIG. 13.

However, the plastic zipper equipped with the slider and a bag body equipped with the zipper suffer from the disadvantage in that unwanted unsealing is unpreventable, since the plastic zipper in a closed state can readily be opened by pulling the protrusions G2-1, G2-2 with the slider S from the outside of the zipper.

The slider of such a constitution that enables unwanted unsealing even after being closed involves a fear of causing contamination with foreign matters or abnormal quality due to unwanted unsealing. Thus in order to eliminate the disadvantage, the present inventor previously proposed a plastic zipper which was equipped with a slider and which was capable of performing completely sealed packaging with a zipper alone and of detecting that unsealing had been made after the sealed packaging, and a bag body equipped with the zipper {refer to Japanese Patent Application Laid-Open No. 345057/2000 (Heisei 12)}.

As exemplified on FIG. 14 through 17, the plastic zipper which is equipped with a slider and a means for detecting unwanted unsealing and a bag body equipped with the zipper each comprise a pair of a male hook and a female hook formed on a plastic surface, have a continuous tightening wall 1-2 and a continuous pressing rib 1-4 that are parallel to the male hooks 1-1 on the inside thereof, and are equipped with a means for bonding the surfaces of the continuous tightening wall 1-2 and the continuous pressing rib 1-4 with easily peelable plastic layers A-1, B-1 in a state of the zipper being engaged and a means for bonding the protrusions G2-1, G2-2 each serving as a guide for the slider that are formed parallel to a pair of male and female hooks 5-1, 5-2 on the plastic surfaces with easily peelable plastic layers A-8, B-8 in a state of the zipper being engaged.

The above-mentioned means are capable of easily opening and closing the zipper by means of the slider as disclosed in the aforesaid Japanese Patent Application Laid-Open No. 130594/2001 after the easily peelable plastic layers are peeled off. However, in order to steadily carry out the peeling of the easily peelable plastic layers with the aforesaid slider, the opening force of the slider needs to be greatly increased by reason of unstable peeling force of the easily peelable plastic layers. Hence, the protrusions serving as a guide for the slider and the inside guide for the slider must be large-sized, thus bringing up the problem that the slider is unusable for a small bag.

Japanese Patent Registration No. 3,026,839 describes a method for opening and closing the zipper fitted with a rib on the end portion of a flange attached to the opening side of the zipper by the use of a slider having a vertical lower side wall portion and a member in inverse U shape. The method, although being easy to obtain the opening force, is required to enlarge the member in inverse U shape inside the slider, when applied to the hermetically sealable zipper which is disclosed in the aforesaid Japanese Patent Registration No. 2,938,784 relating to the proposal of the present inventor and which is excellent in hermetical sealability and the like. Consequently the method is inapplicable to a small bag.

The present inventor proposed a plastic zipper equipped with a slider and imparted with a means for preventing unwanted unsealing, in which the plastic zipper is equipped with a slider and a pair of male and female hooks for sealing formed on plastic surfaces, and is fitted with a pair of male and female hooks for guiding the slider parallel to the hooks for sealing on the opening side, and the inside guide for the slider is positioned between the hooks for sealing and the hooks for guiding the slider {Japanese Patent Application Laid-Open No. 375501/2000 (Heisei 12)}.

The constitution of the aforesaid plastic zipper is such that the hooks for guiding the slider are firstly opened, and the hooks for sealing are opened by catching the inside guide for the slider on the hooks for guiding the slider thus opened. It is possible to simultaneously use these inventions, that is, to install a pair of male and female hooks for guiding the slider parallel to the hooks for sealing on the opening side of the plastic zipper in which the surfaces of the above-mentioned continuous tightening wall and continuous pressing rib are bonded with easily peelable plastic layers. Nevertheless, as is the case with the slider mentioned before, the slider just mentioned involves the problem of being inapplicable to a small bag. Under such circumstances, the development of a plastic zipper equipped with a slider capable of markedly increasing an opening force in spite of its being miniaturized has eagerly been desired.

DISCLOSURE OF THE INVENTION

As a result of intensive research and investigation, the present inventor has developed a plastic zipper equipped with a slider capable of markedly increasing an opening force in spite of its being miniaturized and a bag body equipped with the zipper, in order to apply a plastic zipper equipped with a slider to a small bag without impairing the characteristics of the zipper even if the zipper has an extremely high opening strength as is the case with a hermetically sealable zipper in which the above-mentioned continuous tightening wall and continuous pressing rib are bonded with easily peelable plastic layers.

The structures for realizing the objectives are summarized as follows.

1. A hermetically sealing plastic zipper equipped with a slider whereby the zipper is opened and closed comprises a pair of a male hook and a female hook formed on plastic films, installing flanges on the opening portion sides for each of the male hook and female hook thereof, connecting the respective ends of the flanges, and pressing a wedged opening plate into the inside of a closed plastic cylinder which is constituted of the flange portions connected respective ends thereof and extended to the hermetically sealing plastic zipper in an engaged state so that the hermetically sealing zipper is firstly opened and after the hermetically sealing zipper is opened, the top portion of the flanges in a connected state is disconnected.

2. In the hermetically sealing plastic zipper equipped with a slider as set forth in the item 1, the hermetical sealability of the zipper is maintained by not allowing to form a closed plastic cylinder which is constituted of the flange portions connected to the hermetically sealing plastic zipper in an engaged state at the point of time and position where the opening end of the slider reaches the closing end of the hermetically sealing zipper by the sliding operation of the slider.

3. In the hermetically sealing plastic zipper equipped with a slider as set forth in the item 2, a slit at a portion of the flanges corresponding to the opening plate at the closing end position of the hermetically sealing zipper is made so as not to allow the closed plastic cylinder to be formed.

4. In the hermetically sealing plastic zipper equipped with a slider as set forth in the item 1, a second zipper or a rib is installed at the end portions of each of the flanges at the opening portion side of the male hook and female hook for the hermetically sealing zipper in an engaged state in order to connect the end portions.

5. In the hermetically sealing plastic zipper equipped with a slider as set forth in the item 4, the connected state of the end portions of each of the flanges at the opening portion side of the male hook and female hook for the hermetically sealing zipper are maintained in an engaged state by installing a connecting groove parallel to the hermetically sealing zipper above the opening plate for the slider, a second zipper or a rib is placed in the connecting groove, and a cover is installed on the opening portion of the connecting groove.

6. In the hermetically sealing plastic zipper equipped with a slider as set forth in the item 4, the hermetical sealability of the zipper is maintained by not allowing to form a closed plastic cylinder which is constituted of the flange portions connected to the hermetically sealing plastic zipper in an engaged state at the point of time and position where the opening end of the slider reaches the closing end of the hermetically sealing zipper by the sliding operation of the slider.

7. In the hermetically sealing plastic zipper equipped with a slider as set forth in the item 6, the portion of the second zipper or the rib corresponding to the opening plate at the closing end position of the zipper is crushed to flatness or cut off so as not to allow the closed plastic cylinder to be formed.

8. The hermetically sealing plastic zipper equipped with the slider as set forth in the item 1 can be installed on an opening portion of a bag body.

DESCRIPTION OF THE SYMBOLS IN THE DRAWINGS

| | |
|---|---|
| F: | plastic film |
| F1-1, F1-2: | female hook for a hermetically sealing plastic zipper |
| M1-1, M1-2: | male hook for a hermetically sealing plastic zipper |
| F2: | female hook for a second zipper |
| M2: | male hook for a second zipper |
| R1: | continuous pressing wall |
| R2: | continuous pressing rib |
| S: | slider |
| S1: | opening plate |
| S2: | cover |
| S3: | opening stanchion |
| S4: | connecting groove |
| S5: | protrusion for preventing falling off |
| S6: | closing wall for a hermetically sealing plastic zipper |
| S7: | closing wall for a second zipper |
| B: | rib |
| E1: | opening end of a zipper |
| E2: | closing end of a zipper |

PREFERRED EMBODIMENTS TO CARRY OUT THE INVENTION

Figure 1:
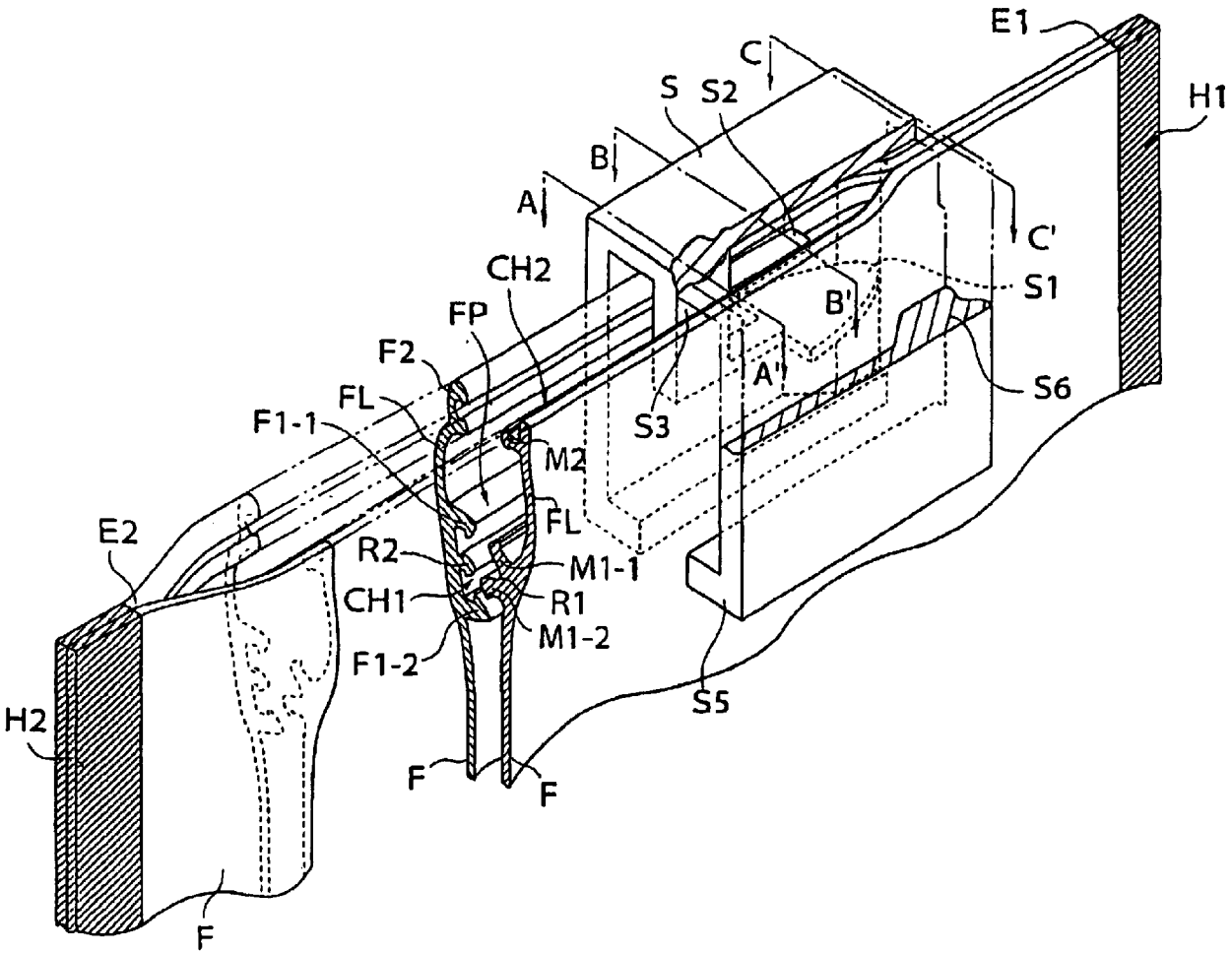
FIG. 1 is a schematic perspective view showing a partially cutaway bag body equipped with a plastic zipper fitted with a slider.
Figure 2:
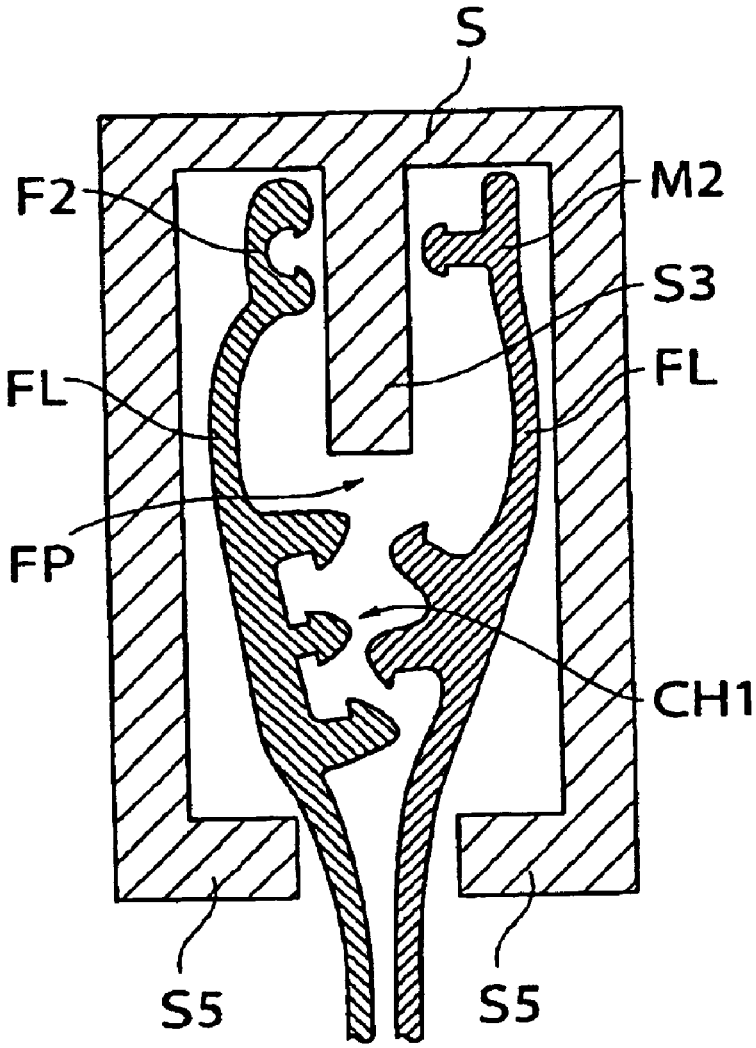
FIG. 2 is a cross sectional view taken along line A'A' of FIG. 1.
Figure 3:
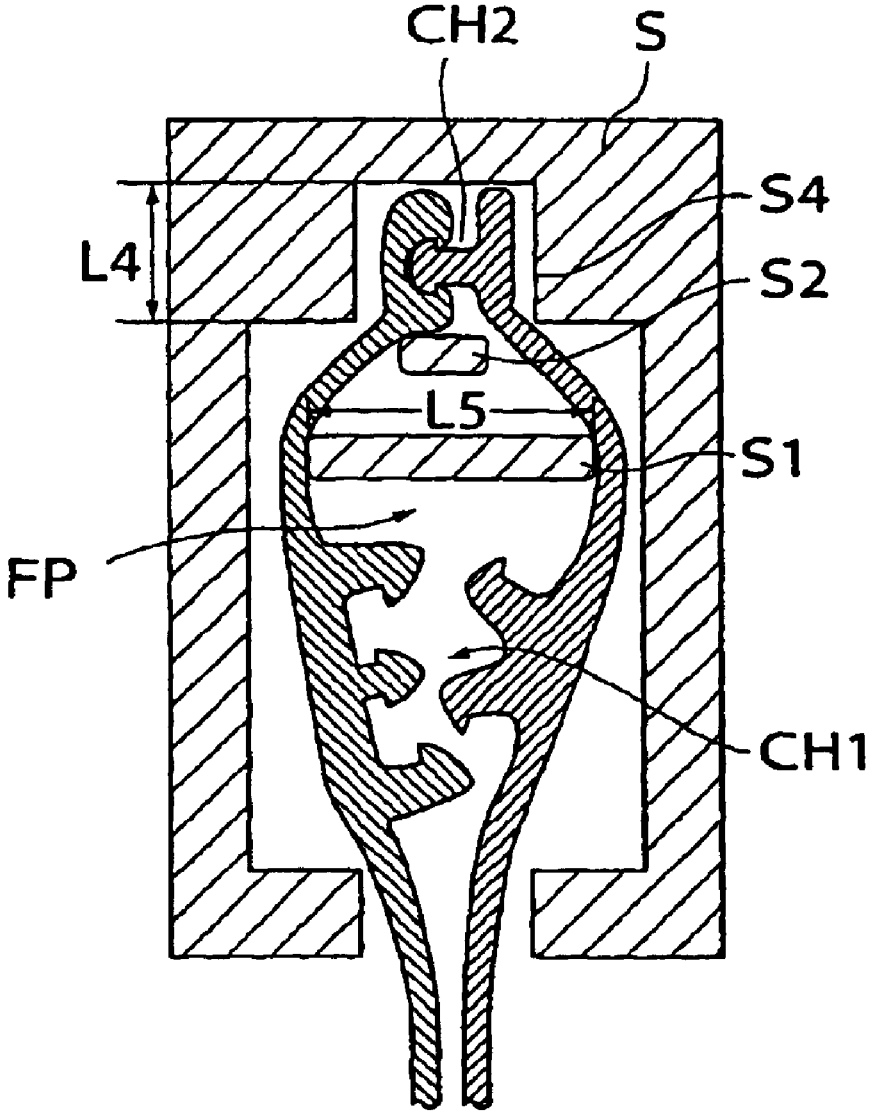
FIG. 3 is a cross sectional view taken along line B–B' of FIG. 1.
Figure 4:
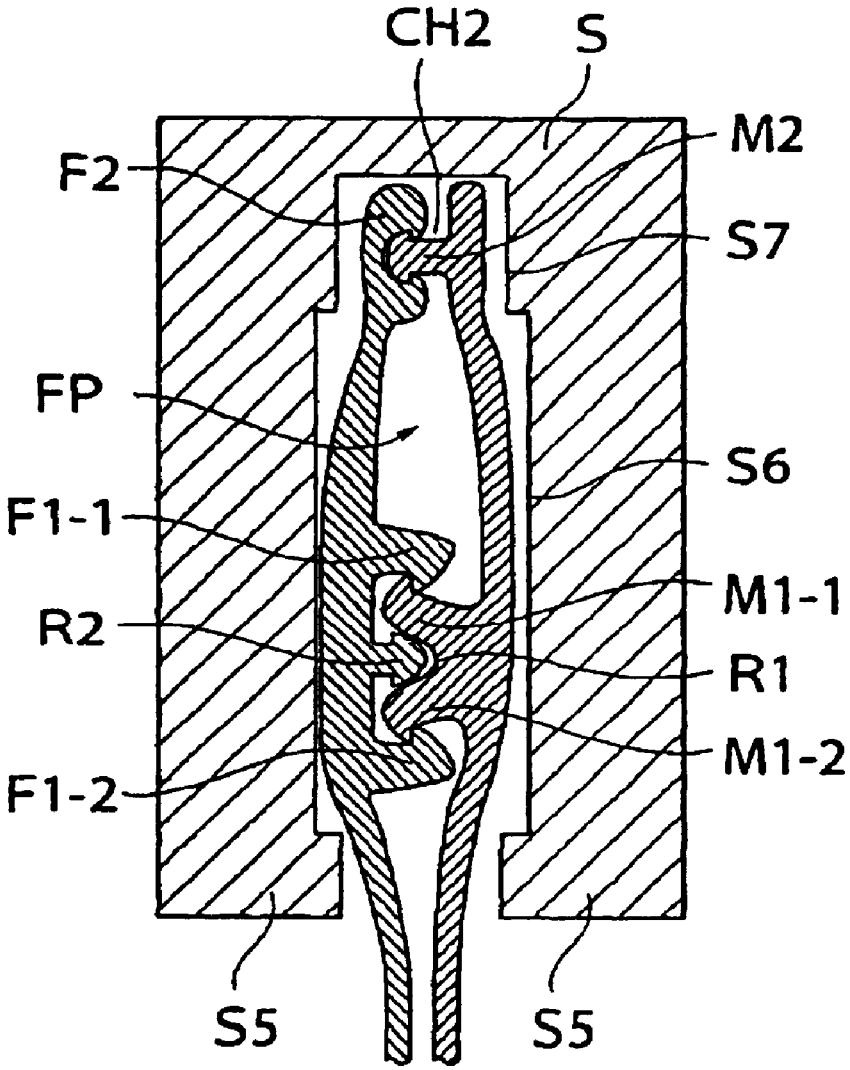
FIG. 4 is a cross sectional view taken along line C'C' of FIG. 1.

The embodiments of the present invention will be described with reference to FIG. 1 through FIG. 9. FIG. 1 is a schematic perspective view showing a partially cutaway bag body equipped with a plastic zipper fitted with a slider. FIG. 2 through FIG. 4 are each a cross sectional view taken along line A–A' of a slider opening end in FIG. 1, a cross sectional view taken along line B–B' of an opening plate in FIG. 1, and a cross sectional view taken along line C–C' of the slider closing end in FIG. 1, respectively.

Figure 5:
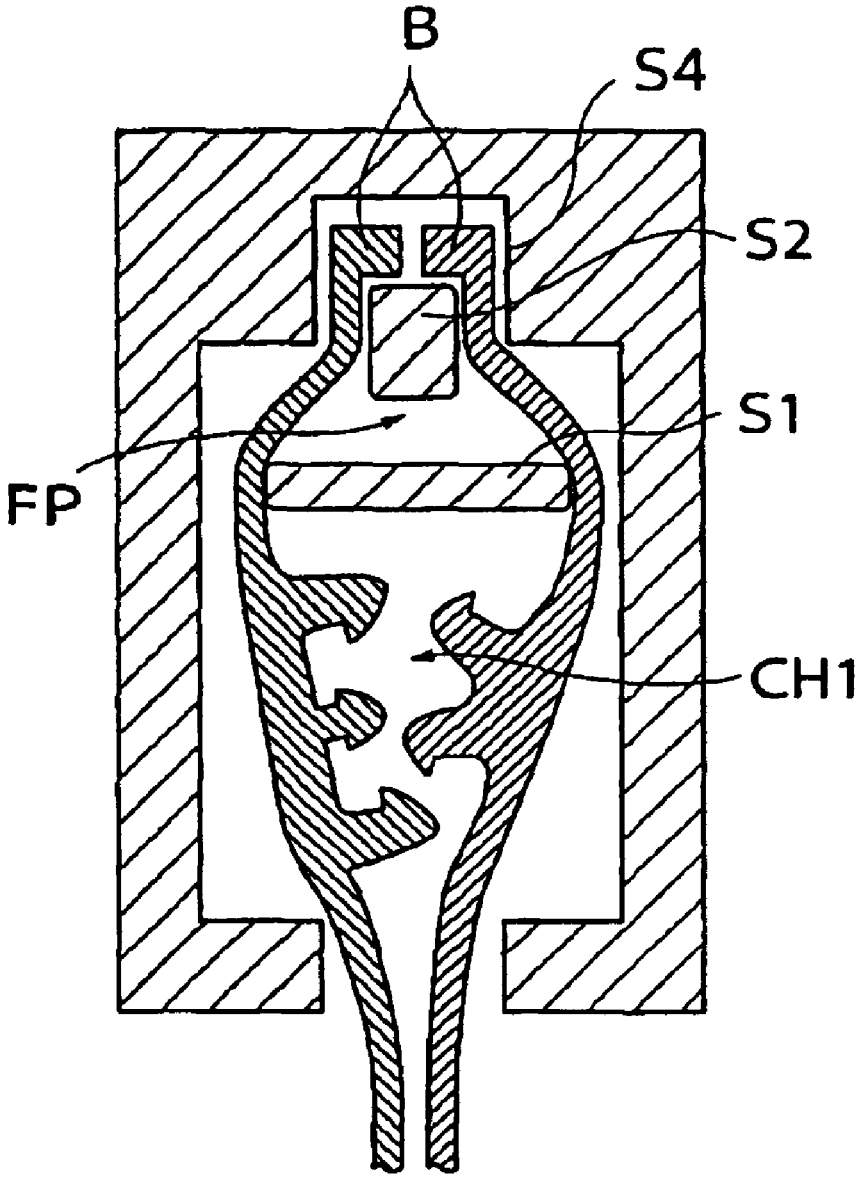
FIG. 5 is a cross sectional view which corresponds to FIG. 3 and in which a rib of a different shape is installed in place of a second zipper.
Figure 6:
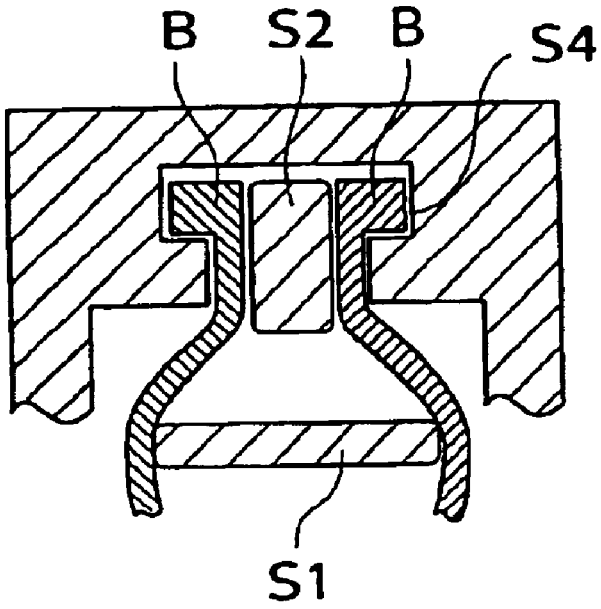
FIG. 6 is a fragmentary sectional view of FIG. 5.
Figure 7:
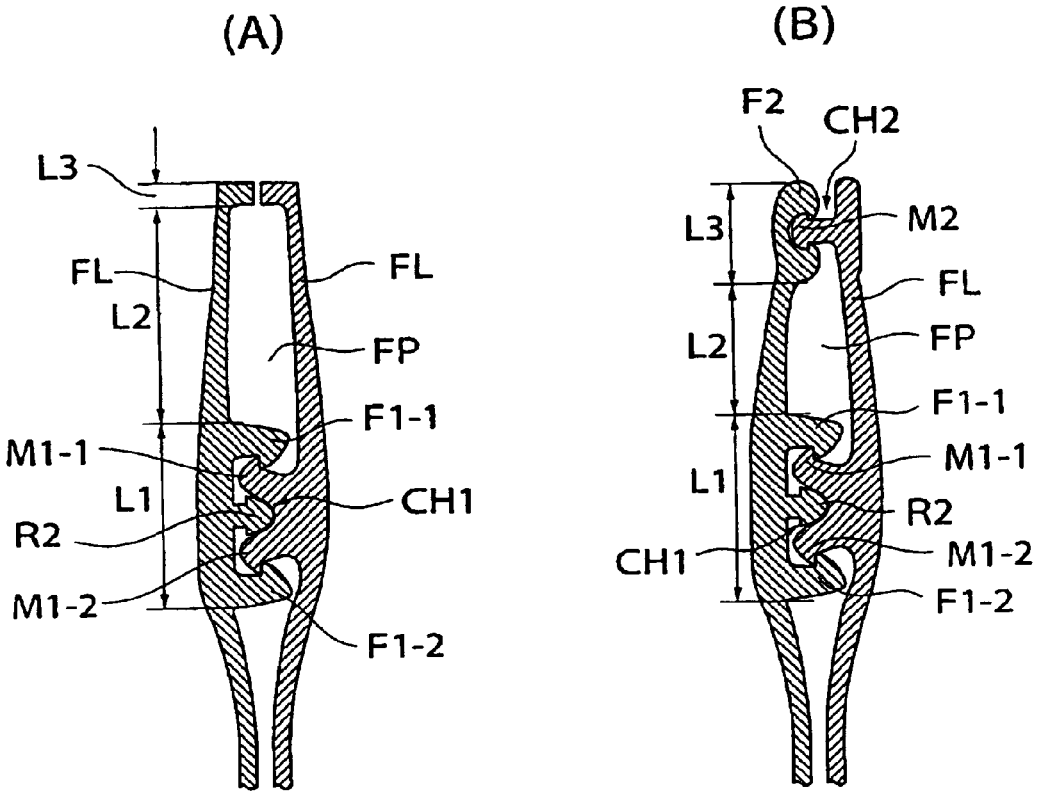
FIGS. 7(A)–7(B) are each a cross sectional view for the purpose of explaining the dimensional relationship of each of portions.

FIG. 5 and FIG. 6 are each a cross sectional view and a fragmentary sectional view, respectively, both corresponding to FIG. 3 and illustrating a rib of a different shape instead of a second zipper.

In these figures, F is a plastic film, F2/M are each a female hook in a second zipper and a male hook in the same, respectively. F1-1 and F1-2 are each a female hook for a hermetically sealable plastic zipper, M1-1 and M1-2 are each a male hook for the hermetically sealable zipper, respectively, R1 and R2 are each a continuous pressing wall and a continuous pressing rib, respectively, S is a slider, S1 is an opening plate, S2 is a cover, S3 is an opening stanchion, S4 is a connecting groove, S5 is a protrusion for preventing falling off, S6 is a closing wall for a hermetically sealing plastic zipper, S7 is a closing wall for a second zipper, B is a rib, E1 is an opening end of a zipper and E2 is a closing end of a zipper.

As illustrated on FIG. 1, a hermetically sealing zipper CH1 is formed on the surface of the plastic film F, which comprises the pairs of male and female hooks F1-1, F1-2, M1-1, M1-2; the continuous pressing wall R1; and the continuous pressing rib R2. In a plastic zipper equipped with a slider, the hermetically sealing zipper is opened and closed by the slider S, a flange (extension portion) FL is installed on each opening portion side of male and female hooks for the hermetically sealing zipper CH1, and a second zipper CH2 composed of a pair of male and female hooks is installed on each end portion of the flange FL.

In this case, when the slider S is slid towards the closing end of the zipper E2, the hermetically sealing zipper and the second zipper are closed. Conversely, when the slider S is slid towards the opening end of the zipper E1, both the zippers are opened.

In the above-mentioned plastic zipper equipped with the slider, when the slider S is slid towards the closing end of the zipper E2, the closing wall for the hermetically sealing plastic zipper S6 and the closing wall for a second zipper S7 that are installed on the cross section C–C' in FIG. 4 cause the male and female hooks to engage with each other, so that the hermetically sealing zipper and the second zipper are closed almost simultaneously.

Conversely when the slider S is slid towards the opening end of the hermetically sealing zipper E1, as illustrated on FIG. 4, the wedged opening plate S1 illustrated on FIG. 3 is firstly pushed into the inside of a closed plastic cylinder FP which is constituted of the flange portions that are connected with the hermetically sealing zipper and the second zipper each in an engaged state, and thereby the hermetically sealing zipper is opened. However, the second zipper CH2 still remains unopened at this step, since it is housed in the connecting groove S4 and is pressed by the cover S2.

The width of the connecting groove S4 used for keeping a closed state of the hermetically sealing zipper CH1 after its opening is made larger than the width of the opening stanchion S3 immediately in front thereof, whereby the function of the groove for opening prevention is substantially eliminated or the connecting groove itself is removed. Thereafter as illustrated on FIG. 2, the opening stanchion 53 is used to open the second zipper CH2, whereby the bag equipped with the zipper is opened.

Although the function was explained with reference to the hermetically sealing zipper CH1 and the second zipper CH2, a rib B illustrated on FIG. 5 or FIG. 6 may be used in place of the second zipper CH2. The shape of the rib B is not limited to a shape of a rectangle, but may be of a different shape such as a triangle or semicircle. In addition, the hermetically sealing zipper, which has been exemplified by a special hermetically scaling zipper as disclosed in Japanese Patent Registration No. 2,938,784, is not limited thereto. Likewise, the second zipper is not limited to the zipper as exemplified hereinbefore. That is to say, each of the zippers may be of any type. Needless to say, the zipper according to the present invention is applicable to a bag body equipped with a zipper in which the plastic zipper according to the present invention is formed in a tape form, and is fusedly bonded into a bag body at a lower portion of a the zipper.

Figure 8:
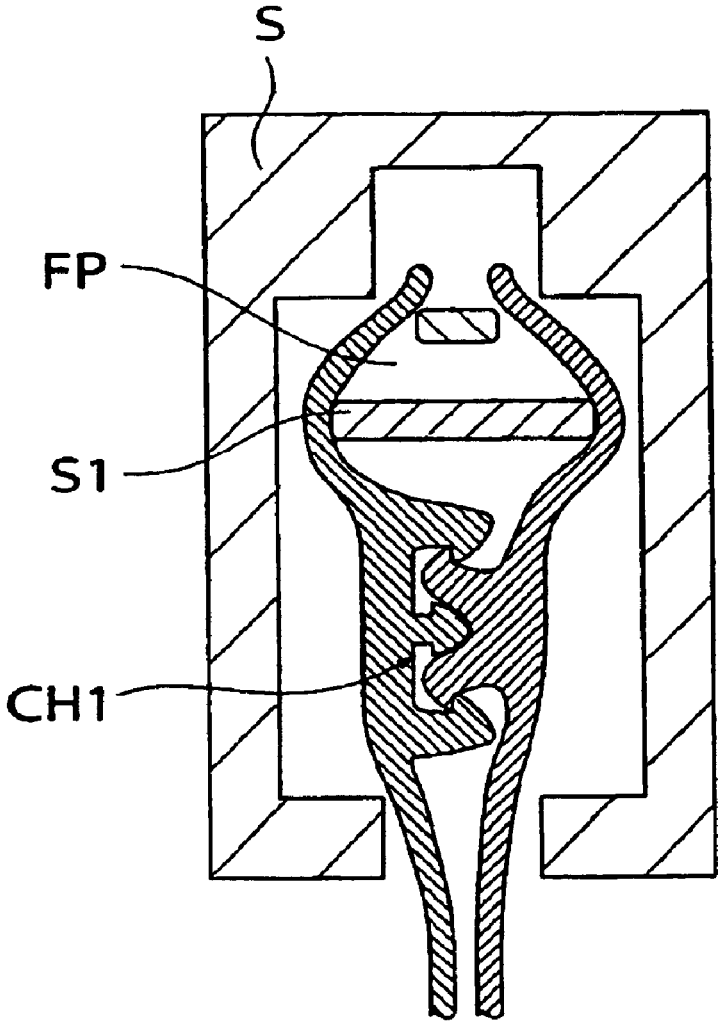
FIG. 8 is a cross sectional view showing a configuration for the purpose of not allowing a plastic cylinder to be formed at a closing end position of a hermetically sealing plastic zipper.

When the slider opening end A–A' reaches the closing end E2 of the hermetically sealing zipper in FIG. 1, a portion of the second zipper or the rib, which portion comes in contact with the opening plate, is crushed to flatness by a heat seal or the like, or alternatively, the second zipper or rib is cut off at the position of the closing end E2, thereby as illustrated on FIG. 8, not allowing to form a closed plastic cylinder which is constituted of the flange portions connected to the second zipper or the rib and the hermetically sealing plastic zipper in an engaged state at the closing end position of the hermetically sealing zipper. Consequently, since the top side of the flange is made mobile thereby even if widened by the opening plate, any force of opening the underside of the hermetically sealing plastic zipper is never generated, whereby hermetical sealability thereof can be maintained.

Figure 9:
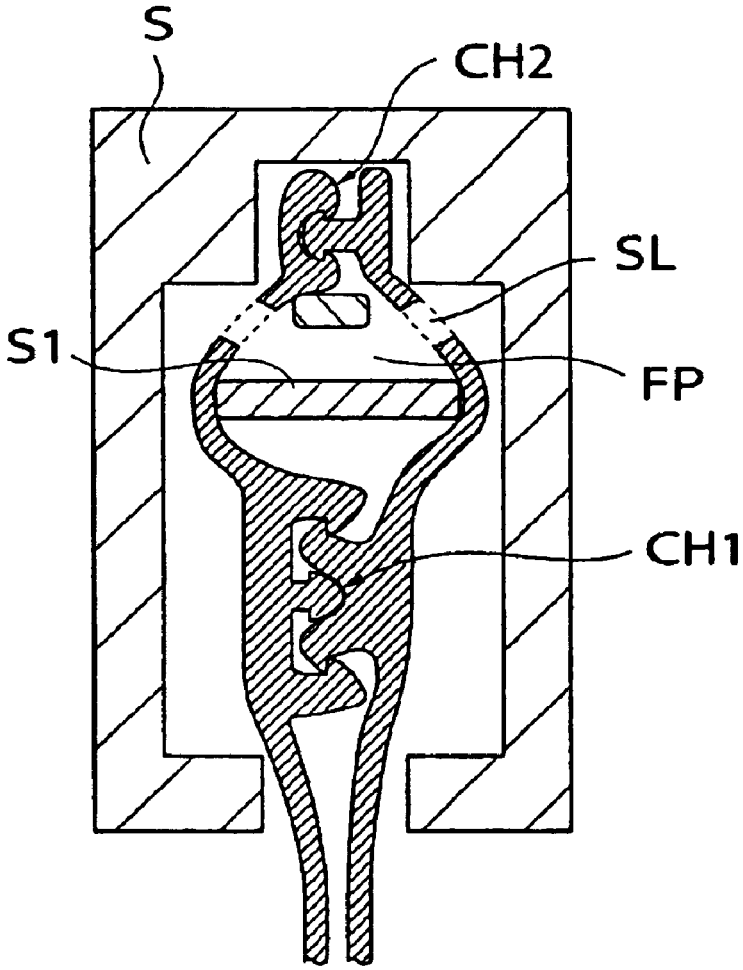
FIG. 9 is a cross sectional view showing another configuration for the purpose of not allowing a plastic cylinder to be formed at a closing end position of a hermetically sealing plastic zipper.

In addition to the foregoing, when the slider opening end A–A' reaches the closing end E2 of the hermetically sealing zipper, a slit SL is made in a portion of the flange FL between the second zipper or the rib and the hermetically sealing zipper CH1 at the position of the closing end E2, thereby as illustrated on FIG. 9, not allowing to form a closed plastic cylinder which is constituted of the flange portions connected to the second zipper or the rib and the hermetically sealing zipper in an engaged state at the closing end position of the hermetically sealing zipper. Consequently, since the top side of the flange is made mobile thereby even if widened by the opening plate, any force of opening the underside of the hermetically sealing plastic zipper is never generated, whereby hermetical sealability thereof can be maintained.

The above-mentioned slit according to the present invention, although seemingly resembling the slit or notch described in Japanese Patent Registration No. 3,026,839, is fundamentally different therefrom in terms of its function. Specifically in the method in the Japanese Patent Registration No. 3,026,839, it is a prerequisite to open a rib at the end of a flange to open a zipper, and the significance of the existence for the slit or notch is not to allow the rib to open, or to disconnect the zipper therefrom even if the rib is opened.

In the present invention, as opposed to the foregoing, the rib at the end of the flange portion is not opened but is consistently closed at the time of opening the zipper or actuating the slit or notch, differently from the method in the Japanese Patent Registration No. 3,026,839. Specifically, the slit or notch according to the present invention exists not to allow formation of a closed plastic cylinder which is constituted by connecting the flexible flange portions, thereby rendering itself entirely different from that of the above-noted Patent in terms of its function and structure.

On the other hand, the slit or notch as described in Japanese Patent Application Laid-Open No. 503672/1998 (Heisei 10) is constituted such that a cantilever flange having rigidity and one opening fulcrum is installed on the opening side of the zipper, and is made into an inverse T-shaped separate structure so that the function of the separate structure is invalidated with the the slit or notch by opening the rigid cantilever flange at the time of opening a zipper.

In the present invention, as opposed to the foregoing, the zipper is opened by pushing the wedged opening plate into the inside of a closed plastic cylinder FP which has flexible flanges FL and is constituted by connecting the flange portions. Specifically, the slit or notch according to the present invention does not allow formation of a closed plastic cylinder, thereby rendering itself entirely different from that of the Japanese Patent Application Laid-Open No. 503672/1998 in terms of its function and structure.

Figure 10:
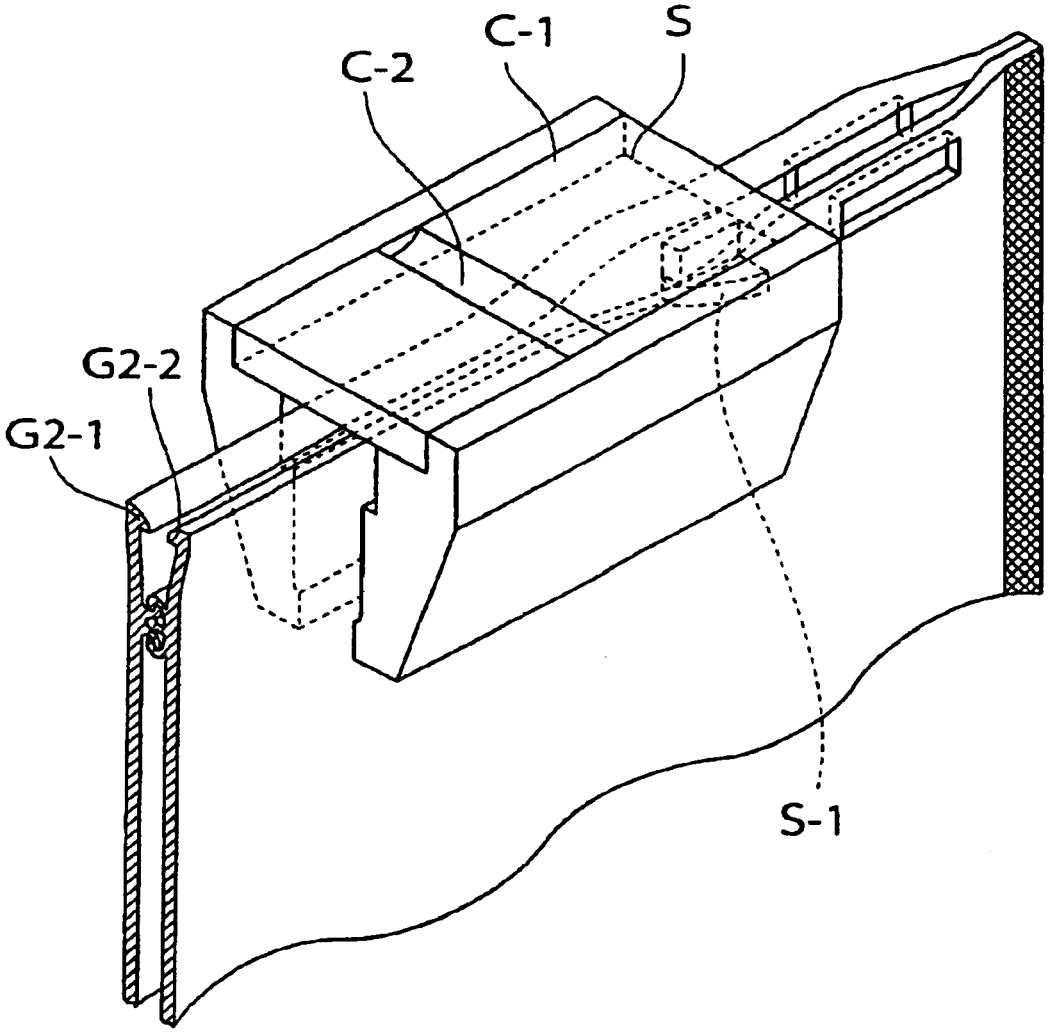
Fig10 PRIOR ART
FIG. 10 through FIG. 13 are each a perspective view showing a plastic zipper fitted with a slider and a slider proposed by the present inventor and shown in Japanese Patent Application Laid-Open No. 130594/2001.
Figure 11:
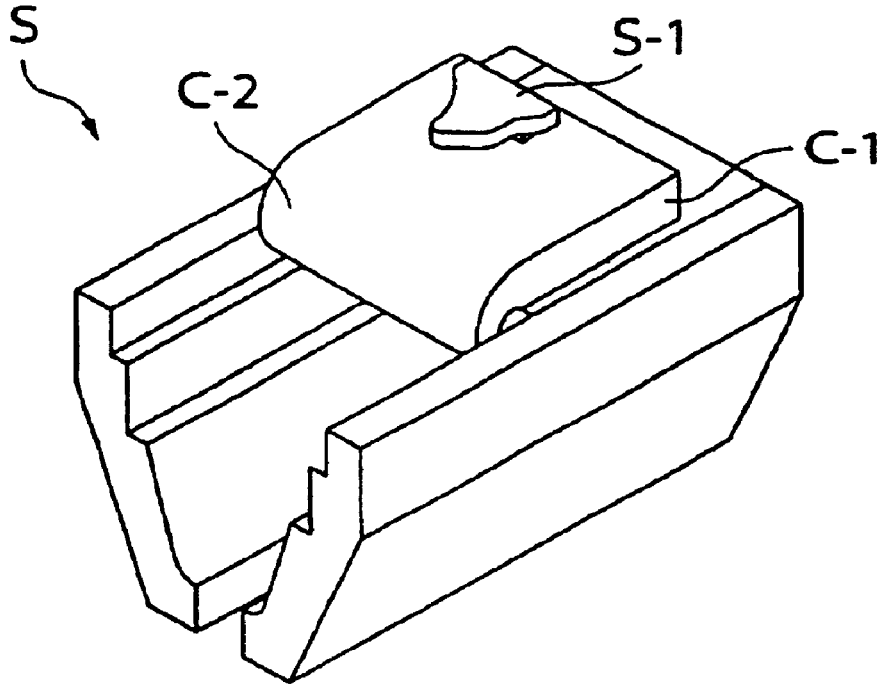
Fig11 PRIOR ART
Figure 12:
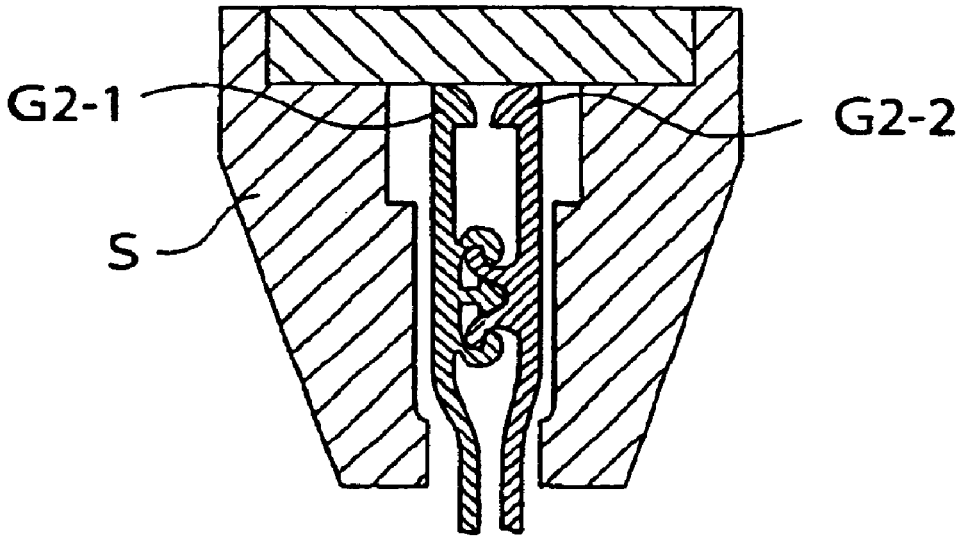
Fig12 PRIOR ART
Figure 13:
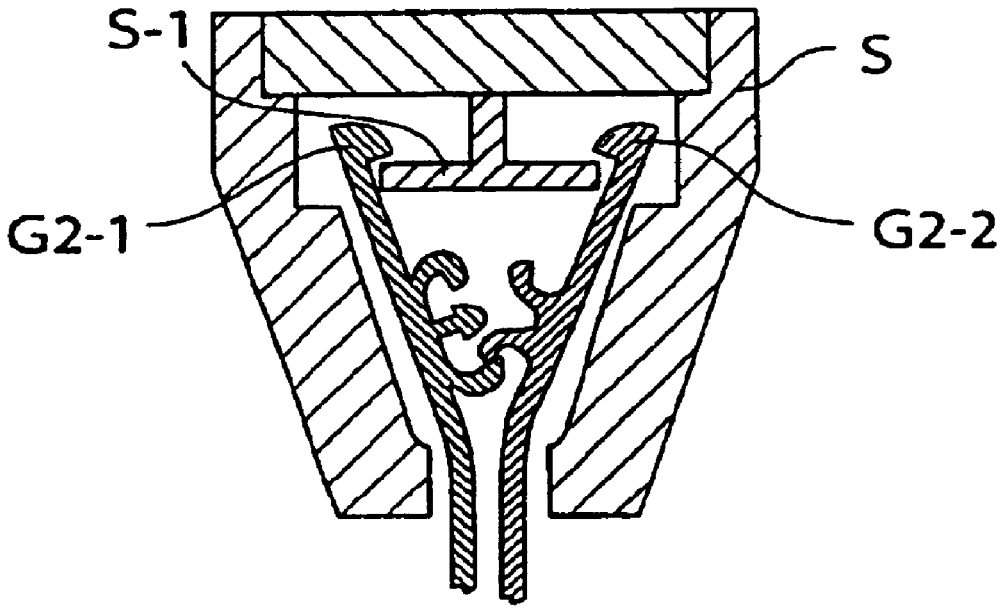
Fig13 PRIOR ART
Figure 14:
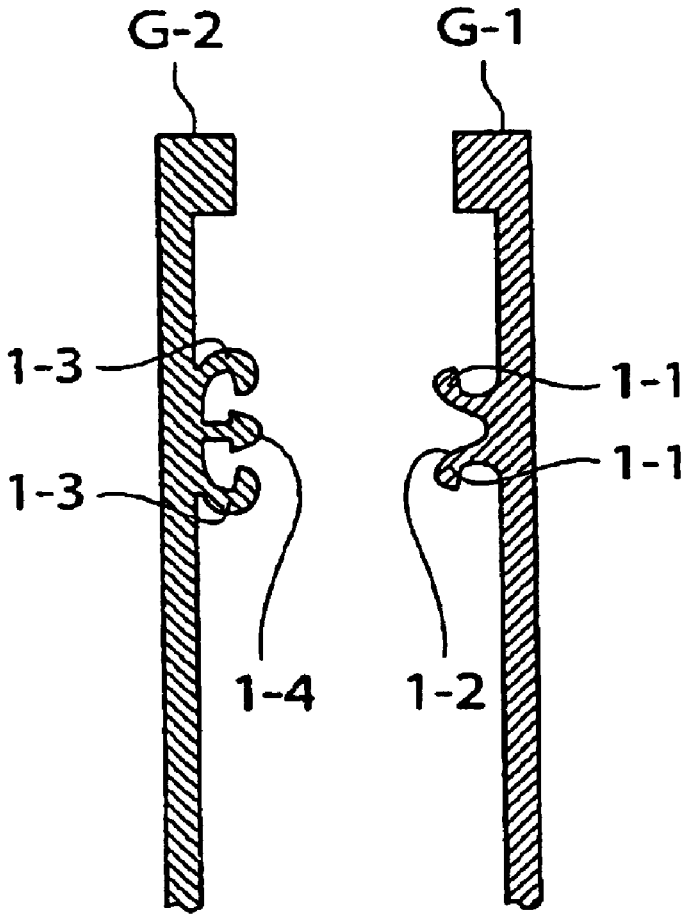
Fig14 PRIOR ART
FIG. 14 through FIG. 17 are each a perspective view showing a plastic zipper fitted with a slider and a slider which were proposed by the present inventor and shown in Japanese Patent Application Laid-Open No. 345057/2000.
Figure 15:
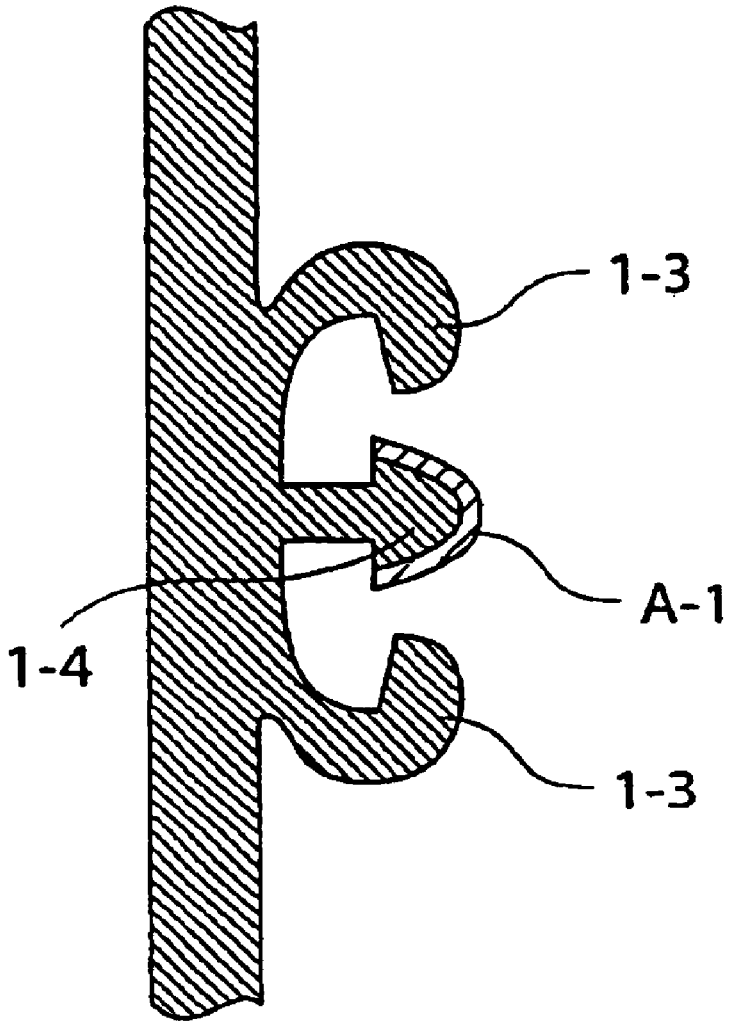
Fig15 PRIOR ART
Figure 16:
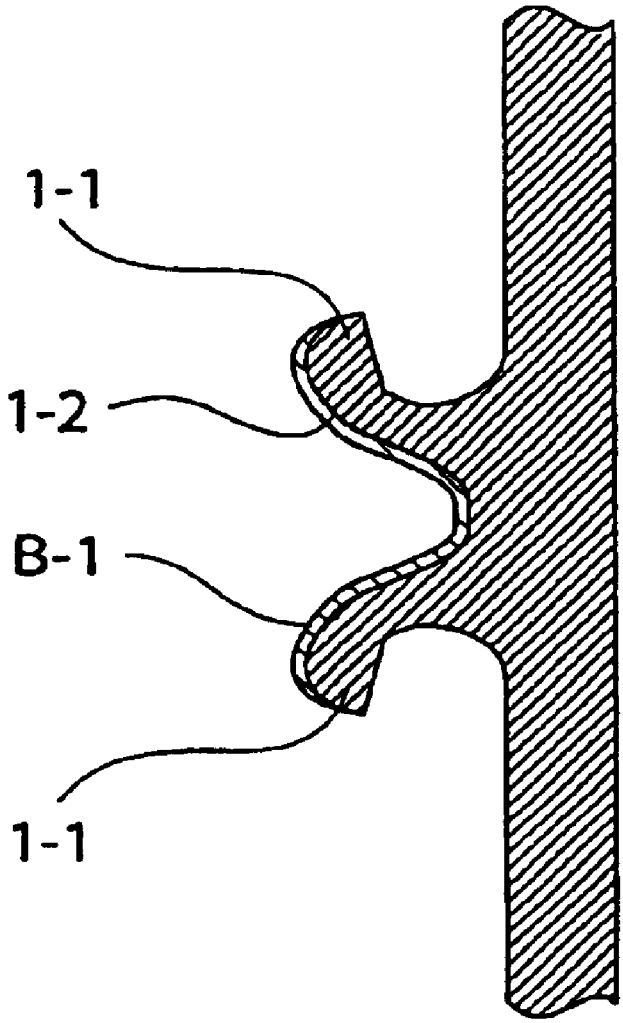
Fig16 PRIOR ART
Figure 17:
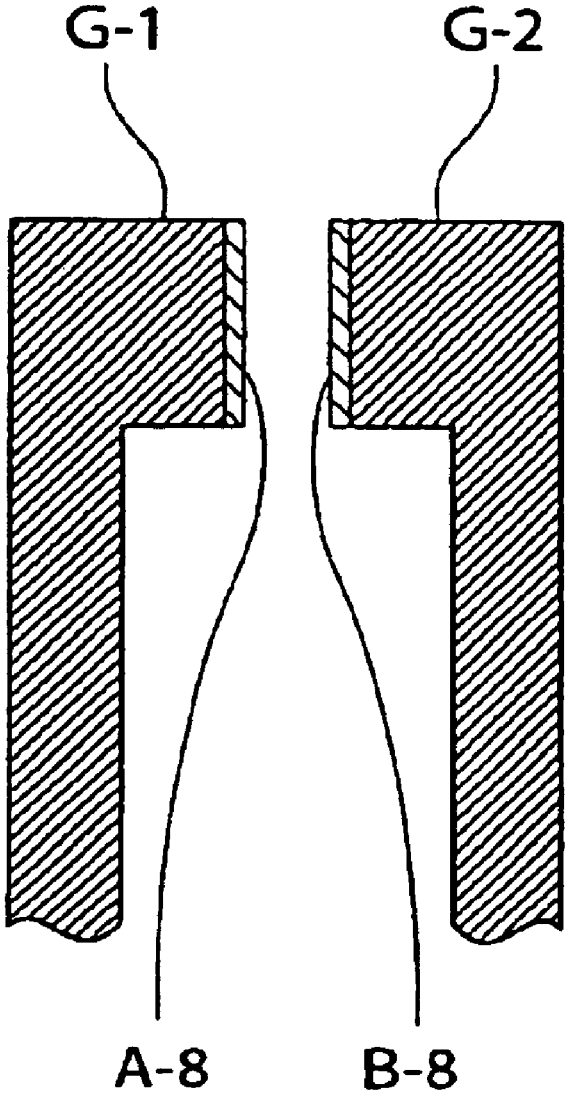
Fig17 PRIOR ART

The slider to be used in the present invention is preferably a knocked-down slider. There is usable as a knocked-down slider, the slider as illustrated on FIG. 10 and FIG. 11 as disclosed by the present inventor in Japanese Patent Application Laid-Open No. 130594/2001. Such a slider is fabricated by attaching the slider to a zipper in a state that a plate portion C-1 equipped with an inside guide S-1 is open and subsequently closing the plate portion C-1.

There is disclosed as a knocked-down slider in U.S. Pat. No. 5,070,583, a slider in which a constituent member for a slider outside guide is enabled to open and close through a flexural axis parallel to a plane containing a bag body. However it is difficult from the aspect of construction to apply such a slider to the zipper according to the present invention which requires stable attachment of the connection groove and opening plate. Accordingly, the slider to be used in order to carry out the present invention is preferably a slider disclosed in the Japanese Patent Application Laid-Open No. 130594/2001 (Heisei 13) and which is assembled by closing the guide constituent member through a flexural axis perpendicular to a plane containing a bag body as illustrated on FIG. 10 and FIG. 11.

In the case of carrying out the present invention by the use of the hermetically sealing zipper (FIG. 14 through FIG. 17) in which the engaging portion of the zipper in an engaged state is bonded with easily peelable plastic layers, the zipper being described in the aforesaid Japanese Patent Application No. 345057/2000 relating to the proposal of the present inventor, at the time of assembling the slider by closing the plate portion C-1 of the slider in the aforesaid Japanese Patent Application Laid-Open No. 130594/2001, the slider needs to be assembled in a state that the zipper is kept engaged at the closing end position thereof. In carrying out the present invention, when the inside dimension of the flange L2 between the hermetically sealing zipper and the second zipper is set to be constant, the depth L4 of the connecting groove S4 being larger enables the width of the opening plate S1 to be smaller, and conversely the depth L4 being smaller enables the width S1 to be larger.

In order to miniaturize the slider, the width L5 of the opening plate S1 needs to be minimized and thus, the depth L4 of the connecting groove S4 is preferably as close as possible to (L2 plus L3). The maximum depth of the connecting groove S4 is the sum of (L2 plus L3) and the thickness of the opening plate S1, but the depth of the connecting groove S4 is usually smaller than the maximum depth thereof. On the other hand, the length of the rib L2 in contact with the opening plate S1 is preferably in the range of 60 to 150% of the width of the zipper L1. The length of the rib L2, when being larger than the range, leads to an unreasonably large slider, whereas the length, when being smaller than the range, brings about difficulty in closing the plate C-1 as explained on FIG. 11, thereby making it impossible to steadily assemble the hermetically sealing zipper while maintaining the engaged state thereof.

COMPARATIVE EXAMPLE 1

A measurement was made of opening strength (in units of KgF/5 cm) of each of 20 sheets taken out of a 100 sheet lot of bag bodies each equipped with a hermetically sealing zipper which was made of linear low density polyethylene (L-LDPE), which had a length of 200 mm and which was fitted with a slider, and a width L1 of 3.5 mm, a flange inside dimension L2 of 1.5 mm and a rib thickness of 0.8 mm, each in FIG. 7(B). As a result, the average opening strength was 2.29 with a standard deviation of 0.39. The bag bodies in the same lot as above in 20 sheets were each equipped with the slider exemplified on FIG. 10 through FIG. 13 and disclosed in Japanese Patent Application Laid-Open No. 130594/2001, and were subjected to opening a closing tests. As a result, all the bag bodies could be easily opened and closed.

COMPARATIVE EXAMPLE 2

A measurement was made of opening strength (in units of KgF/5 cm) of each of 20 sheets that were randomly taken out of a 100 sheet lot of bag bodies each equipped with a hermetically sealing zipper which was made of linear low density polyethylene (L-LDPE), which was fitted with a slider, an easily peelable layer in a thickness of 10 micron on the surface of a continuous tightening wall, which was bonded through the continuous tightening rib and the easily peelable layer, and which had the same dimensions as in Comparative Example 1. As a result, the average opening strength was 3.90 with a standard deviation of 0.44. The bag bodies in the same lot as above in 20 sheets were each equipped with the slider the same as in Comparative Example 1, and were subjected to opening/closing tests. As a result, 6 sheets of the bag bodies could be opened, 3 sheets thereof could not be opened, and 1 sheets thereof were incompletely opened. The slider, even if being capable of easily opening and closing the zipper having a proper opening strength, is sometimes incapable of opening or closing the zipper having a strong opening strength. Accordingly, it is judged that the aforesaid slider is unapplicable to a zipper having a strong opening strength.

EXAMPLE 1

A measurement was made of opening strength (in units of KgF/5 cm) of each of 20 sheets that were randomly taken out of a 100 sheet lot of bag bodies each equipped with a hermetically sealing zipper which was made of linear low density polyethylene (L-LDPE), which was fitted with a slider, an easily peelable layer in a thickness of 10 micron on the surface of a continuous tightening wall, which was bonded through the continuous tightening rib and the easily peelable layer, and which had a width L1 of 3.5 mm, a flange inside dimension L2 of 3.0 mm and a rib thickness of 0.8 mm, each in FIG. 7(B). As a result, the average opening strength was 4.08 with a standard deviation of 0.47. The bag bodies in the same lot as above in 20 sheets were each equipped with the slider which had a cross sectional configuration as illustrated on FIG. 3, and which was fitted with an opening plate having a width L5 of 4 mm, a cover having a width of 1 mm and a connecting groove having a depth L4 of 2 mm, and were subjected to opening/closing tests. As a result, all the bag bodies could be easily opened and closed. Accordingly, it is judged that the aforesaid slider is applicable to a zipper, even if it has a strong opening strength.

INDUSTRIAL APPLICABILITY

According to the plastic zipper equipped with a slider and a bag body fitted with the zipper, the slider is imparted with an extremely high opening strength in spite of its being miniatured and thereby is capable of easily opening a zipper in which hooks themselves or opening end edges themselves are bonded with easily peelable plastic layers for the purpose of preventing unwanted unsealing and which has a strong opening strength.

What is claimed is:

1. A hermetically sealing plastic zipper equipped with a slider whereby the zipper is opened and closed, comprising:

a pair of a male hook and a female hook formed on plastic films;

flanges formed on opening portion sides for each of the male hook and female hook, wherein respective top end portions of the flanges are connectable;

a wedged opening plate pressed into an inside of a closed plastic cylinder constituted by the connectable respective top end portions of the flange and extended to the pair of the male hook and female hook in an engaged state so as to firstly open the male hook and the female hook, wherein after the male hook and the female hook are opened, the connectable respective top end portions of the flanges in a connected state are disconnected.

2. The hermetically sealing plastic zipper equipped with a slider according to claim 1, wherein at a point of time and position where an opening end of the slider reaches a closing end of the zipper by a sliding operation of the slider, the closed plastic cylinder constituted by the connectable respective top end portions of the flanges and extended to the pair of the male hook and female hook in an engaged state is prevented from being formed at the closing end position of the zipper to maintain the hermetical sealability of the zipper.

3. The hermetically sealing plastic zipper equipped with a slider according to claim 2, wherein a slit is made at a portion of the flanges corresponding to the wedged opening plate at the closing end position of the zipper to prevent the closed plastic cylinder from being formed at the closing end position of the zipper.

4. The hermetically sealing plastic zipper equipped with a slider according to claim 1, wherein a second zipper or a rib is installed at the connectable respective top end portions of each of the flanges at the opening portion sides of the male hook and female hook for the zipper in an engaged state to connect the connectable respective top end portions.

5. The hermetically sealing plastic zipper equipped with a slider according to claim 4, wherein the connected state of the second zipper or the rib installed at the connectable respective top end portions of each of the flanges at the opening portion side of the male hook and female hook for the zipper in an engaged state is maintained by installing a connecting groove parallel to the zipper above the opening plate for the slider, placing the second zipper or the rib in the connecting groove, and installing a cover on the opening portion of the connecting groove.

6. The hermetically sealing plastic zipper equipped with a slider according to claim 4, wherein at a point of time and position where the opening end of the slider reaches the closing end of the zipper by the sliding operation of the slider, the closed plastic cylinder constituted of the connectable respective top end portions of the flanges and extended to the pair of the male hook and female hook in an engaged state is prevented from being formed at the closing end position of the zipper, to maintain hermetical sealability of the zipper.

7. The hermetically sealing plastic zipper equipped with a slider according to claim 6, wherein a portion of the second zipper or the rib corresponding to the opening plate is crushed to flatness or cut off at the closing end position of the zipper to prevent the closed plastic cylinder from being formed at the closing end position of the zipper.

8. The hermetically sealing plastic zipper equipped with a slider according to claim 6, wherein a slit is made at a portion of the flanges corresponding to the wedged opening plate at the closing end position of the zipper to prevent the closed plastic cylinder from being formed at the closing end position of the zipper.

9. A bag body fitted with the hermetically sealing plastic zipper equipped with the slider as set forth in claim 1.

* * * * *